United States Patent [19]

Blechner

[11] Patent Number: 4,474,202

[45] Date of Patent: Oct. 2, 1984

[54] WALKER DEVICE

[76] Inventor: Ralph Blechner, P.O. Box 2218, Norwalk, Conn. 06852

[21] Appl. No.: 378,853

[22] Filed: May 17, 1982

[51] Int. Cl.[3] ..... A61H 3/00

[52] U.S. Cl. ..... 135/67

[58] Field of Search ..... 135/67; 272/70.3, 70.4; 280/8, 9, 10, 11, 12 H, 12.1, 28, 647, 648, 87.02 R, 87.02 W, 87.04 R; 297/5, 6, DIG. 10; 5/81 R, 81 B, 86; D21/191, 192, 224, 225; D3/7, 8, 9

[56] References Cited

U.S. PATENT DOCUMENTS

| | | | |
|---|---|---|---|
| 1,834,979 | 12/1931 | Skoglund | 280/12 H |
| 2,591,912 | 4/1952 | Block | 272/70.3 |
| 2,627,904 | 2/1953 | Thieman | 272/70.3 |
| 2,900,008 | 8/1959 | Seger | 272/70.3 |
| 3,085,258 | 4/1963 | Wolferts | 5/503 |
| 3,421,529 | 1/1969 | Vestal | 135/67 |
| 3,690,652 | 9/1972 | Schneider | 135/67 X |
| 3,783,886 | 1/1974 | Thomas | 135/67 |
| 4,021,033 | 5/1977 | Auclair et al. | 272/70.3 |
| 4,094,331 | 6/1978 | Rozsa | 135/67 |
| 4,135,535 | 1/1979 | Thomas | 135/67 |
| 4,314,576 | 2/1982 | McGee | 135/67 |

FOREIGN PATENT DOCUMENTS

| | | | |
|---|---|---|---|
| 1330189 | 5/1963 | France | 272/70.3 |
| 2274274 | 1/1976 | France | 135/67 |

*Primary Examiner*—Robert A. Hafer
*Assistant Examiner*—Arnold W. Kramer

[57] ABSTRACT

A walker device for aiding crippled or infirm persons to walk and to rise from a sitting position to a standing position. The walker device includes a mechanism located at floor level and secured to the legs of the device for applying foot pressure to the frame of the walker as the person rises from a sitting position to a standing position.

7 Claims, 5 Drawing Figures

WALKER DEVICE

BACKGROUND OF THE INVENTION (1) Field of the Invention

The present invention relates to a walker device for aiding crippled or infirm persons to walk and to rise from a sitting position to a standing position.

(2) Description of the Prior Art

A conventional walker comprises a frame including a plurality of generally upright legs. A crippled or infirm person using the walker holds hand rails located in the upper region of the frame as the person walks. After the person has taken several steps, the walker is lifted and moved forwardly to support the person during the next several steps taken. One type of conventional walker is made from lightweight aluminum tubing. The legs of the walker may be telescopic to enable the height to be adjusted and the walker may be collapsable to provide for its storage.

Many crippled or infirm persons find it quite difficult to rise from a sitting position to the standing position wherein the walker can be used. When an infirm person attempts to use a conventional walker, the person grasps the handrails and attempts to raise himself to the standing position. As the person pulls on the handrails, a conventional walker tends to pivot about the lower end portion of its rear legs, thus making it quite difficult for a person to rise and, in some instances, this instability may result in the person falling and being injured.

The problem of the instability of a walker when a person attempts to rise from a sitting position to a standing position is recognized in U.S. Pat. No. 3,085,258 to Wolferts. This patent discloses the use of a holder that is rigidly attached to a bed or some other object that holds the walker in place as a person rises to a standing position. Although the holder disclosed in the Wolferts patent appears to function adequately, such holder is only suitable for the specific piece of furniture to which it is attached. Another approach to aids for use in rising from a sitting position to a standing position is disclosed in U.S. Pat. No. 3,739,793 to Wilson. The Wilson patent discloses a device that has relatively long lower legs which are in contact with the floor which are said to provide stability for the aid when a person attempts to rise from a sitting position. Another device to assist aiding a person to rise from a sitting position to a standing position is disclosed in U.S. Pat. No. 3,668,723 to Bratton.

It is an object of the present invention to provide a walker that not only assists the person to walk, but also, assists the person in rising from a sitting position to a standing position. It is a further object of the invention to provide a simplified and lightweight walker achieving the aforementioned functions. It is a further object of the invention to provide a mechanism by which a conventional walker can be modified without extensive changes to provide a walker which assists a person to rise from a sitting position to a standing position. Other objects and advantages of the walker in accordance with the present invention will be apparent from the following description.

SUMMARY OF THE INVENTION

A walker device in accordance with the present invention comprises a frame including a plurality of supporting legs. The upper portion of the frame is graspable by a person so that at least a portion of the person's weight may be supported as the person walks. The walker device includes a mechanism for aiding a person to rise from a sitting position to a standing position wherein the person can use the device to assist in walking. The mechanism is located at floor level and is secured to the frame and provides for the application of foot pressure to the frame as the person rises. Foot pressure on the frame stabilizes it and holds it in position as the person rises. Preferably, the mechanism comprises a plate having a generally flat upper surface for enabling stable placement of the person's foot thereon.

In a preferred embodiment of the invention, the frame includes four generally upright legs. Two of the legs are located at the left side of the frame and the other two are located on the right side of the frame. Each side of the frame includes a plate for applying foot pressure to the frame. The plate extends between the legs of each side and has its end portion secured to the legs. When a person desires to rise from a sitting position to a standing position, he places the walker adjacent to the chair in which he is sitting. The person places his left foot on the left plate and his right foot on the right plate and grasps the upper part of the frame. As the person exerts arm force to lift his body, the frame is securely held in place by the foot pressure. It should be understood that in the absence of the plates or other means for applying foot pressure, the frame tends to pivot about its rear legs when a person applies arm force to the upper part of the frame to attempt to rise. The walker device of the present invention is advantageous in that as the person uses the device to aid him to walk from one chair to another chair, the walker device is available to assist him to rise from the various chairs. Thus, the mobility of an infirm or crippled person who would normally require the assistance of another to rise from a sitting position is increased by use of the walker device of the present invention.

In accordance with one aspect of the invention, each plate includes at its rear end a segment that extends past the rear leg. This plate extension resists pivoting of the frame about the end portion of the rear leg when a person pulls on the frame to attempt to rise from a sitting position. Additional advantages of the walker device in accordance with the present invention will be described in the detailed description of the invention which follows.

DETAILED DESCRIPTION OF THE INVENTION

Figure 1:
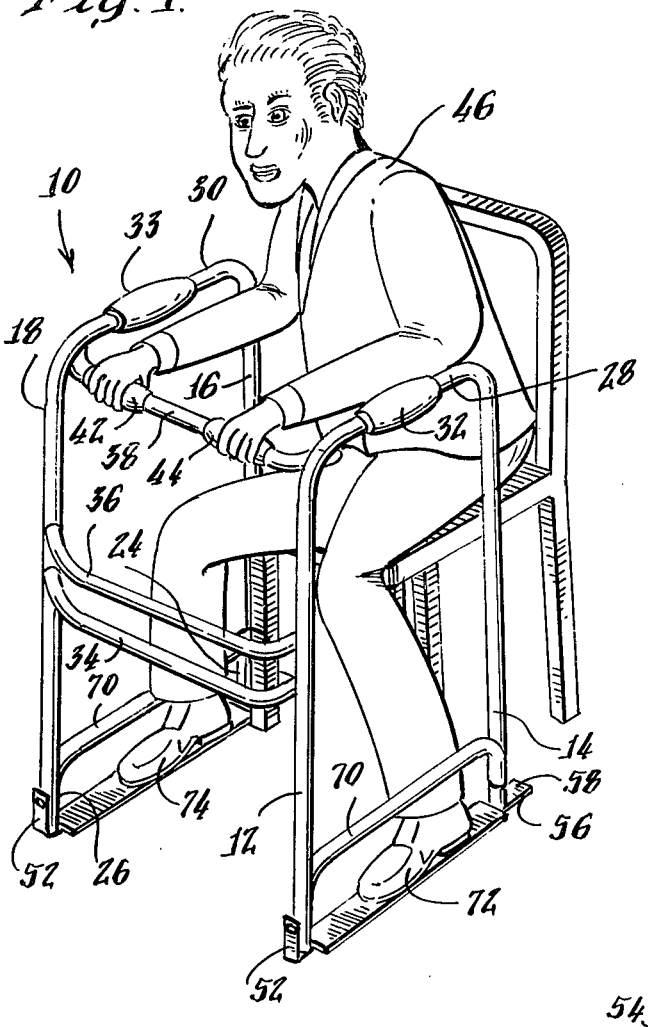
FIG. 1 is a perspective view of a walker device in accordance with the present invention wherein a person is shown in a sitting position and is using the walker device to rise from the sitting position to a standing position.

Referring to FIG. 1, the walker device of the present invention is shown in a perspective view. The walker device 10 includes four generally upright legs 12, 14, 16 and 18. Two of the legs 12 and 14 are located to the left side of the frame 10 and the other two legs 16 and 18 are located to the right side of the frame. Each leg 12, 14, 16 and 18 includes a respective end portion 20, 22, 24 and 26. The legs are preferably made from lightweight aluminum tubing, although other lightweight materials may be used. The legs as shown in FIG. 1 of the drawings are made of a single piece of tubing and are not telescopic. However, it should be understood that each of the legs may be of the telescopic type conventionally used in walker devices. The upper portions of legs 12 and 14 are joined by an integral tubular member 28 and likewise, the upper portions of legs 16 and 18 are joined by an integral tubular member 30. The tubular members 28 and 30 have hand grips 32 and 33 mounted thereon. These handgrips are grasped by the person during walking.

In order to connect the left and right sides of the frame 10, the walker includes at least one and preferably a plurality of tubular supports 34, 36 and 38 extending between the front legs 12 and 18. As shown in FIG. 1, these tubular supports are made from a single piece of aluminum tubing. However, it should be understood that the tubing can include a mechanism for allowing the frame to collapse for compact storage such as, for example a hinge as is conventionally used in walkers. Tubular support 38 preferably includes handgrips 42 and 44 mounted thereon for being grasped by a person attempting to rise from a sitting position to a standing position. As shown in FIG. 1, the person 46 is grasping handgrips 42 and 44.

Figure 2:
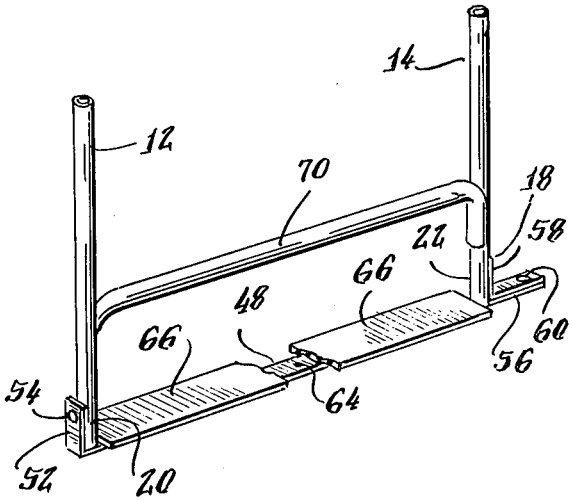
FIG. 2 is an enlarged perspective view of the left plate attached to the walker device shown in FIG. 1.
Figure 3:
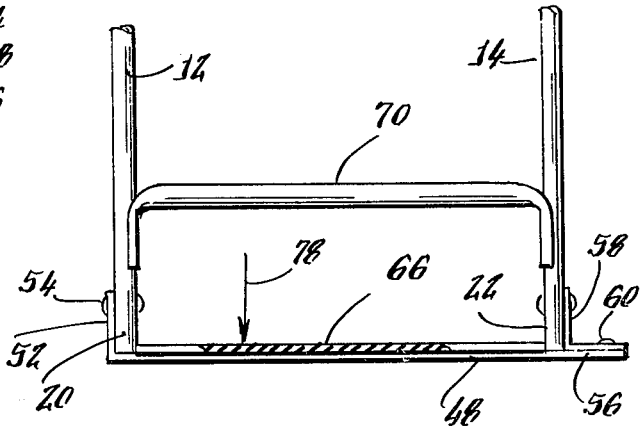
FIG. 3 is a side plan view of the plate shown in FIG. 2.

As shown in FIG. 2, as well as in FIGS. 1 and 3, each side of the walker device includes an elongate flat plate 48 and 50 extending between its legs. Plates 48 and 50 are similar in construction, and, thus only plate 48 will be described hereinafter. Plate 48 shown in FIG. 2 has one end attached to the bottom portion 20 of the front leg 12 and has another end attached to the bottom portion 22 of rear leg 14. It should be understood that the plate 48 can be attached by various mechanisms. As shown in FIG. 2, the front end portion of plate 48 is bent at right angles upwardly to form an upwardly extending L-shaped portion 52. This L-shaped portion can be secured to the bottom portion 20 of the leg by one or more bolts 54 or other fastening means. As shown particularly well in FIG. 3, the plate includes at the rear end thereof a segment 56 that extends past the rear leg 14. As will be described in detail hereinafter, segment 56 aids in resisting pivoting movement about the end portion 22 of rear leg 14 when a person attempts to use the walker device to rise from a sitting position.

The end 56 of plate 48 may be secured to the bottom portion 22 of leg 14 by any suitable means. In the embodiment shown in FIG. 3, an L-shaped bracket is provided and has one leg attached by bolt 60 to plate end 56 and the other leg attached to the lower portion 22 of leg 14 by bolt 62. As shown particularly well in FIGS. 2 and 3, the plate 48 includes an upper surface 64 upon which a person may place his foot. In order to reduce the possibility of slippage between the person's foot and the plate, the plate may optionally have secured to the upper surface thereof a sheet 66 of rubber material or other polymeric material that reduces slippage between the sole of the shoe and the plate. It should be understood, however, that the use of a non-slip sheet is optional and other means for reducing slippage between a person's foot and the plate may be used such as, for example, roughing the upper surface 64 of plate 48. The plate is preferably made from lightweight aluminum, however, it should be understood that other materials may be used.

The bottom surfaces of plates 48 and 50 may optionally be coated with a composition that provides for slippage between the plate and the floor, such as, for example, a coating of polytetrafluoroethylene sold under the trade designation TEFLON. Alternatively, a sheet of polymeric material may be adhered to the bottom surface of plates 48 and 50 to provide slippage between the floor and the plates.

As shown in FIGS. 1, 2 and 3, the walker includes a generally horizontally disposed support brace 70 that extends between and is attached to the bottom portions of the legs. The function of brace 70 will be described hereinafter.

Referring in particular to FIG. 1, use of the walker to enable a person to rise from a sitting position to a standing position will now be described. The person 46 places his left foot 72 on the left plate of the walker device, and likewise, the person places his right foot 74 on the right plate of the walker. The person grasps handgrips 42 and 44. For additional support, the person may place his elbows on the generally horizontal supporting members 28, and, more particularly as shown in FIG. 1, the person's left elbow 76 has been placed upon tubular support member 28. As the person attempts to rise, he pulls rearwardly with his hands on handgrips 42 and 44 and urges himself upwardly with his elbows and with his leg muscles. As shown in FIG. 3, the person's foot exerts a force indicated by arrow 78. The imposition of this foot force aids in preventing the walker device from pivoting rearwardly about the lower end of rear leg 14. As shown in FIG. 3, plate extension 56 also aids in preventing the walker device from pivoting about rear leg end portion 22.

Referring once again to FIG. 1, once the person raises himself from the sitting position to a standing position, the walker device is used in a manner similar to other conventional walker devices. With the walker device of the present invention, the person is quite mobile and can move from chair to chair. Also, the person may use the walker device to lower himself from a standing position to a sitting position. For example, the person may once again place his feet on plate 48 to stabilize the walker device as he sits down.

Referring once again to FIG. 1, as the person attempts to rise from a sitting position, the imposition of foot force, (force 78 as shown in FIG. 3) together with exertion of force by the hands of the person, place the plates 48 in a state of tension. In order to relieve some of the stress placed on the plates 48 as well as the lower end portions of the legs, a generally horizontally disposed brace 70 is secured in generally parallel relation to and in spaced relation to its respective footplate 48. As the person rises and the plates 48 are placed in tension, support braces 70 are placed in compression and aid in stabilizing the plates and preventing the legs from bending or otherwise distorting.

Figure 4:
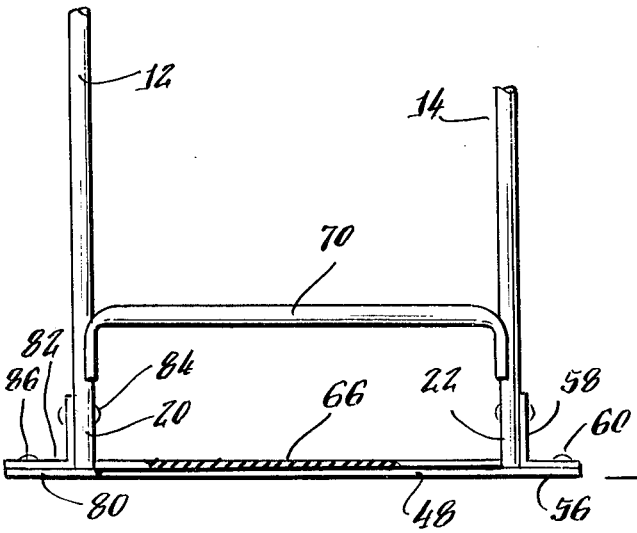
FIG. 4 is a side plan view of an alternative embodiment of a plate.

Another embodiment of the invention is shown in side plan view in FIG. 4. The walker shown in FIG. 4 is similar to that shown in FIG. 3 with the exception that the front end of plate 48 includes an extension 80. As shown in FIG. 4, the plate 48 is secured to front leg 12 by the use of an L-shaped bracket 82 having one leg secured to leg 12 by a bolt 84 and the other leg secured to plate 48 by bolt 86. Extension 80 aids in preventing the walker device from pivoting about the end portions of the front legs after a person has risen to a standing position. It should be understood that as a person rises from a sitting position to a standing position, he moves forwardly and has a certain amount of forward momentum. The crippled or infirm person, may lack sufficient muscle control of stop his forward movement at the desired time. Thus, with the conventional walker, the walker may tend to pivot about the end portion of its front legs and cause the person and the walker to fall. With the use of extension 80 of plate 48, the walker tends to resist forward pivoting movement after a person has risen to a standing position.

Figure 5:
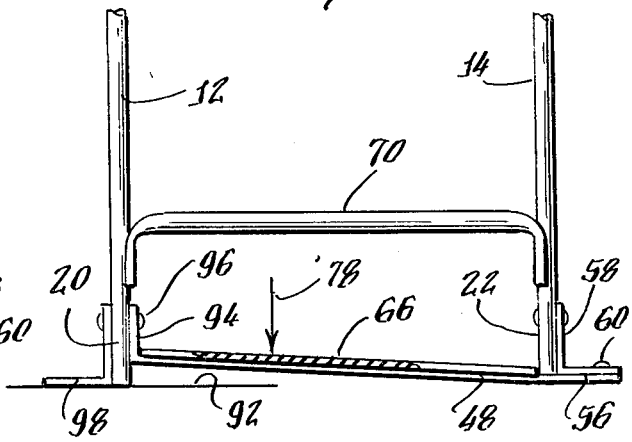
FIG. 5 is a side plan view of still another embodiment of the plate.

Another embodiment of a walker in accordance with the present invention is shown in FIG. 5. As shown in FIG. 5, the front end portion 90 of plate 48 is elevated slightly from floor level 92. The end 90 of plate 48 is bent upwardly in an L-shape to form leg 94 which is attached to the leg of the walker by a bolt 96. Imposition of a downward force 78 on the inclined plate 48 has the effect of forcing the front leg 12 downwardly so that the walker device is stable when the person rises from a sitting position. Optionally, the front leg 12 of the device may have secured thereto an L-shaped bracket 98 which functions in a manner similar to extension 80 of plate 48 shown in FIG. 4 in that it aids in preventing pivoting of the walker about the end portions of the front legs.

It should be understood that although specific embodiments of the invention have been described herein in detail, such description is for purposes of illustration only and modifications may be made thereto by those skilled in the art within the scope of the invention.

I claim:

1. A walker device for aiding a person to walk and to rise from a sitting position to a standing position, the device comprising:

a frame including two inverted U-shaped members defining four generally upright legs, each said leg including a bottom end portion, bracing means extending between said U-shaped members including at least one bracing member located at the upper region of the U-shaped members, one said U-shaped member forming a left side of said walker device and said other U-shaped member forming a right side of said walker device, said walker device further including for each said side a rigid flat plate located at floor level and secured rigidly to the end portions of its respective legs, each said plate including a generally flat upper surface for enabling stable placement of said persons foot thereon, said legs end portions setting on said flat upper surface, each said side having a rear leg rigidly secured to said plate to provide for imposition of foot force on said plate to resist pivoting of said walker device about said rear legs when said frame is pulled rearwardly, and for each said U-shaped member a generally horizontally disposed support brace extending between said legs, and located at the lower region of the U-shaped members, said support brace extending generally parallel to and spaced from its respective plate to provide a space between said plate and said support brace for insertion of the foot of said person.

2. A walker device according to claim 1 wherein each said plate includes an upper surface having thereof means for reducing slippage between said foot and said plate.

3. A walker device according to claim 2 wherein said means for reducing slippage comprises a sheet of resilient material adhered to said upper surface of each said plate.

4. A walker device according to claim 1 wherein said plate includes at one end thereof a segment that extends past said rear leg, said segment resisting pivoting of said frame about the end portion of said rear leg.

5. A walker device according to claim 4 wherein said bracing member extends between and is rigidly secured with respect to the upper portion of the front legs of said frame, said bracing member being graspable by the person using the walker device to enable said person to pull himself upwardly from a sitting position to a standing position.

6. A walker device according to claim 5 wherein each said plate includes a front segment extending past its respective front leg to resist pivoting of the frame about the front leg of the device.

7. A walker device according to claim 5 wherein for each said rear segment, an L-shaped supporting bracket is provided, one portion of said L-shaped bracket being secured to said plate, said other portion of said L-shaped support extending adjacent said rear leg and secured with respect thereto.

* * * * *